United States Patent [19]

Brunner

[11] 4,345,257

[45] Aug. 17, 1982

[54] PRIMARY RADAR ANTENNA HAVING A SECONDARY RADAR (IFF) ANTENNA INTEGRATED THEREWITH

[75] Inventor: Anton Brunner, Wangen, Fed. Rep. of Germany

[73] Assignee: Siemens Aktiengesellschaft, Berlin & Munich, Fed. Rep. of Germany

[21] Appl. No.: 151,737

[22] Filed: May 20, 1980

[30] Foreign Application Priority Data

Jun. 21, 1979 [DE] Fed. Rep. of Germany ..... 2925063

[51] Int. Cl.[3] ..... H01Q 13/00

[52] U.S. Cl. ..... 343/780; 343/6.5 R; 343/776

[58] Field of Search ..... 343/776–780, 343/725, 854, 754, 756, 840, 6.5 R, 6.5 LL, 6.5 SS, 6.8 R, 6.8 LL, 6 R

[56] References Cited

U.S. PATENT DOCUMENTS

| | | | |
|---|---|---|---|
| 2,589,433 | 3/1952 | Riblet | 343/780 |
| 2,691,731 | 10/1954 | Miller | 250/33.69 |
| 2,767,396 | 10/1956 | Cutler | 343/780 |
| 3,170,158 | 2/1965 | Rotman | 343/100 |
| 3,212,095 | 10/1965 | Ajioka | 343/780 |
| 3,267,477 | 8/1966 | Brickey | 343/756 |
| 3,852,762 | 12/1974 | Henf et al. | 343/780 |
| 3,945,009 | 3/1976 | Trignon | 343/780 |

FOREIGN PATENT DOCUMENTS

| | | | |
|---|---|---|---|
| 604700 | 9/1960 | Canada | 343/780 |
| 1291750 | 3/1962 | France . | |
| 1568812 | 1/1970 | France . | |
| 2366711 | 2/1978 | France . | |
| 2387528 | 11/1978 | France . | |

OTHER PUBLICATIONS

"Antenna Types and Antenna Forms", NTZ, (1961), vol. 2, NTG 1302, (Bartholomae et al., Technical Committee).

Jasik, H., "Antenna Engineering Handbook", McGraw-Hill Book Company, Inc., 1961, pp. 12–18 to 12–19.

*Primary Examiner*—David K. Moore

*Attorney, Agent, or Firm*—Hill, Van Santen, Steadman, Chiara & Simpson

[57] ABSTRACT

A primary radar antenna has a secondary radar antenna or an IFF antenna integrated therewith. Excellent properties with respect to compactness, radiation and frequency dependency are achieved by providing a bilevel pillbox antenna having radiation deflection on a cylindrical parabolic reflector from one interplate space to another. The lower interplate space has, in proximity of the primary radar signal radiator, which is arranged with its radiation center in the focal line of the parabolic reflector, an additional feed for in-coupling of the IFF signal. The antenna is particularly suited as a combined primary and IFF radar antenna for smaller vehicles.

21 Claims, 3 Drawing Figures

PRIMARY RADAR ANTENNA HAVING A SECONDARY RADAR (IFF) ANTENNA INTEGRATED THEREWITH

BACKGROUND OF THE INVENTION

1. Field of the Invention

This invention relates to radar antennas, and more particularly to integrated primary and secondary radar antennas.

2. Description of the Prior Art

Primary radar antennas and secondary radar antennas or identification-friend-foe (IFF) can be designed to be structurally separate, for example in the form of a pillbox antenna and an IFF bar antenna, and can then be combined spatially one above the other. A bar antenna with a series-fed radar antenna and an integrated IFF bar antenna are also known in the art. The disadvantage of the series-fed radar antenna, for example, a wave guide slot antenna, is in its narrow band characteristic and, in particular, in the frequency dependency of the direction of maximum radiation.

SUMMARY OF THE INVENTION

It is the object of the present invention to provide a very compact, low radar antenna structure comprising a primary radar antenna and an IFF antenna integrated therewith, which is suitable for accommodation on small vehicles, and which exhibits optimum properties in the horizontal plane within a larger frequency band width.

According to the present invention, the above object is achieved in that a bilevel pillbox antenna is provided which comprises a cylindrical parabolic reflector and two metallic plates extending perpendicular to the reflector and parallel to one another, with an intermediate plate between the two metal plates, parallel thereto and extending up to a point short of parabolic reflector, so that on both sides of the intermediate plate, interplate spaces result. A primary radar signal radiator is arranged within its radiation center at the focal line of the parabolic reflector in the lower interplate space, and along the length of the cylindrical parabolic reflector a deflection device is provided for deflecting the radiation from the lower interplate space into the upper interplate space. Apparatus is also provided for in-coupling of the IFF signal and is arranged adjacent the primary radar signal radiator.

A simple pillbox antenna is, as is known in the art, formed by a cylindrical parabolic reflector and two metallic plates perpendicular thereto and extending parallel to one another at a spacing of less than a wavelength. The feed here occurs at the focal line. A fan-shaped radiation lobe results. In contrast therewith, a bilevel (or folded) pillbox antenna, as is known per se, has the advantage that the aperture is not partially shaded by the primary radiator.

BRIEF DESCRIPTION OF THE DRAWING

Other objects, features and advantages of the invention, its organization, construction and operation will be best understood from the following detailed description, taken in conjunction with the accompanying drawing, on which.

DESCRIPTION OF THE PREFERRED EMBODIMENTS

Figure 1:
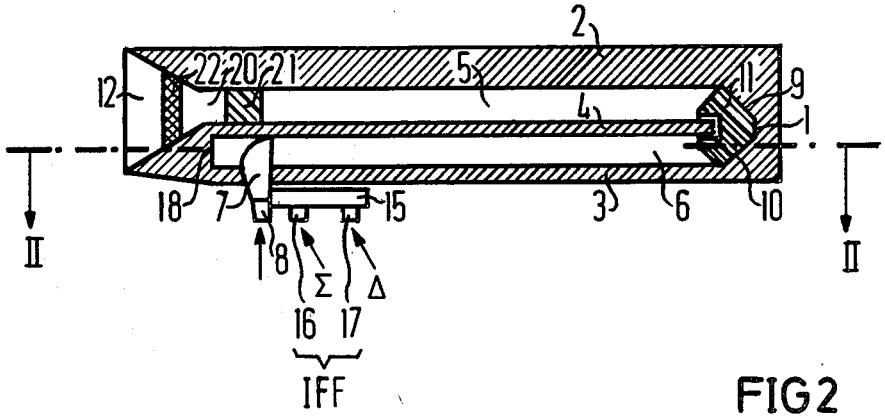
FIG. 1 is a sectional view of a bilevel pillbox antenna for primary radar and IFF signals, constructed in accordance with the present invention, and shown as seen generally along the parting line I—I of FIG. 3.
Figure 2:
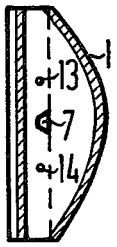
FIG. 2 illustrates, in somewhat of a plan view, the lower portion of the structure of FIG. 1 as viewed generally along the parting line II—II.
Figure 3:
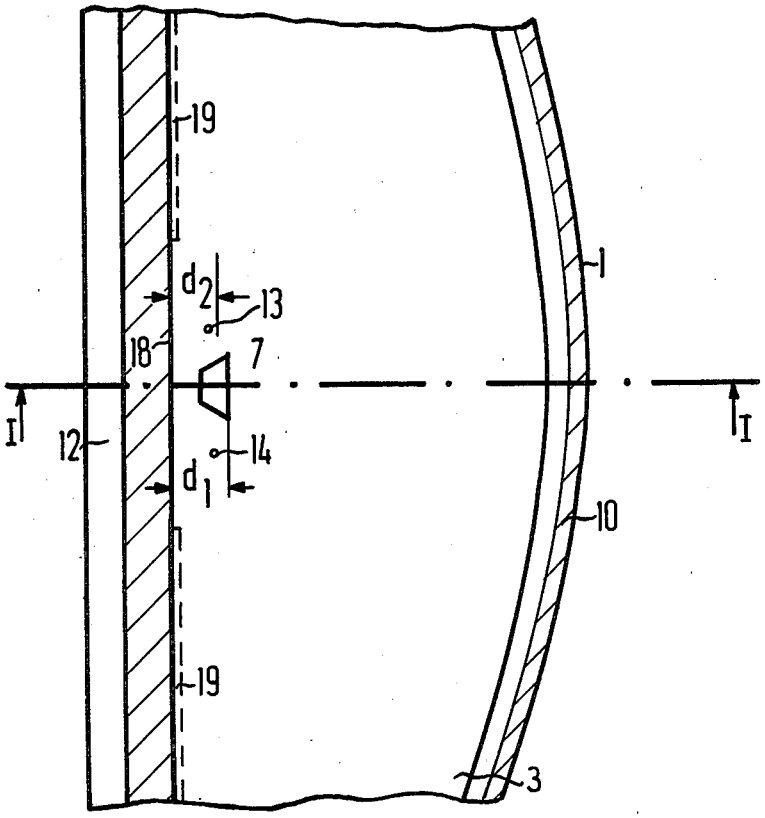
FIG. 3 is an enlarged view of a portion of that illustrated in FIG. 2.

Referring to the drawing, the bilevel pillbox antenna comprises a cylindrical parabolic reflector 1 and two metallic plates 2 and 3, arranged perpendicularly to the cylindrical parabolic reflector 1 and extending parallel to one another, with an intermediate plate 4 therebetween. The intermediate plate 4 does not extend to the parabolic reflector 1. The intermediate plate 4 extends parallel to the two plates 2 and 3. On each side of the intermediate plate 4 an interplate space 5, 6 results. A primary radar signal radiator 7 is arranged in the interplate space 6 with its radiation center at the focal line of the parabolic reflector 1. The primary radar signal radiator 7 can be designed, for example, in the form of an open wave guide or in the form of a small horn-type radiator, for example a deflection horn-type radiator, as illustrated in FIG. 1. The radar signal is provided from a supply 8 and is thus coupled into the lower interplate space 6 by way of the primary radiator 7. The radiation transfer from the lower interplate space 6 into the upper interplate space 5 occurs, in the arrangement according to FIG. 1, with the aid of two 45° oriented surfaces 9 and 10, as seen in section, of the cylindrical parabolic reflector 1. The transition can also occur, however, by the provision of a simple slot between the intermediate plate 4 and the cylindrical parabolic reflector 1. The intermediate plate 4 is mounted in a support mounting 11 comprising a dielectric material which extends along the length of the cylindrical parabolic reflector 1. Such a support mounting of the intermediate plate 4 is, under certain circumstances, preferred to the use of discrete spacing pins, since such pins can cause disturbing inhomogeneity locations to arise. In front of the aperture of the upper interplate space 5, a funnel-shaped opening 12 is provided in order to render possible the desired vertical beaming. Also, in proximity of the aperture, the intermediate plate 4 can be supported by a support 21 comprising dielectric material, which can simultaneously serve for a climatic closing off of the apparatus. At both sides of the primary radar signal feed, i.e. at both sides of the deflection horn-type radiator 7, and hence also at both sides of the pillbox parabola focal line, the IFF in-coupling occurs by means of two radiators 13 and 14. The vertical polarization of the IFF radiators 13 and 14, in the case of horizontal or vertical primary radar polarization, is in every instance capable of propagation and can also be deflected in a problem-free manner into the above-disposed level, i.e. into the interplate space 5. The IFF coupling occurs by means of elongate internal conductors of two coaxial lines and must be adapted or matched because of its short expanse relative to the wavelength. The radiators 13 and 14 which serve for the IFF feed, can be somewhat offset in relation to one another in the transverse direction, so that the spacings of these input coupling radiators 13 and 14 are in each instance different with respect to the primary radar signal radiator 7, and an IFF direction of maximum radiation direction results, squinting in relation to the major lobe, which is necessary for an optimized target-controlled interrogation. A sum and difference formation of the signals of the two IFF radiators 13 and 14 for the purpose of narrowing down the effective lobe widths and for the purpose of side-lobe signal suppression takes place by means of a hybrid circuit 15, secured externally on the plate 3, advantageously directly beneath the IFF input coupling. The sum and difference inputs of the hybrid circuit 15 are referenced 16 and 17.

The lower interplate space 6 is closed off on the side away from the cylindrical parabolic reflector 1 with a metallic rear wall 18. The spacing $d_2$ between the radiator 7 and the two radiators 13 and 14, and the rear wall 18, is advantageously so dimensioned that the rear wall 18 is effective as a subreflector for the IFF signals. In the case of vertical radiation polarization of the primary radar signals to be radiated, as well as of the IFF signals to be radiated, it is advisable to select the spacing $d_1$ between the radiation center of the primary radar signal radiator 7 and the rear wall 18 to be greater than the spacing $d_2$ between the radiators 13 and 14 and the rear wall 18. By this measure, interferences of the primary radar signal through the IFF radiation are avoided. The resulting deviation of the center of gravity of the IFF radiation from the focal line of the cylindrical parabolic reflector 1 is not critical in the case of the customary wavelength for IFF signals of approximately 30 centimeters.

In the more remotely disposed regions of the rear wall 18, interfering reflections can be reduced, for example, by an absorber coating 19. Another possibility of reducing interfering reflection is in the provision of a specific shaping or configuration of the rear wall 18. The two distances $d_1$ and $d_2$ within, however, no longer be constant. However, through such a shaping a desired coverage of the cylindrical parabolic reflector 1 can be achieved.

In the frequency range of over approximately 8–10 GHz, through the use of circular, instead of linear, polarization, an improved rain echo (or clutter) suppression can be achieved. The polarization issuing from the pillbox aperture, for example, vertical, can be converted into a circular polarization by means of a polarizer or polarization grid 22 in the region of the funnel in which the horizontal polarization is capable of propagation. Such a polarizer or polarization grid 22, as is known, comprises, for example, wires inclined at 45° relative to the aperture edges, or meander lines which produce, in addition to the present emission, for example, vertical E-vector, an equal-sized 90° phase-shifted horizontal E-vector, so that the desired circular polarization results.

For the IFF signal, this polarization conversion is undesired, since also the signals of the transponders to be interrogated are vertically polarized. An arrangement of the polarizer or polarization grid within the funnel 12 at a location at which the transverse dimension lies below half an IFF wavelength, prevents the excitation of a horizontal IFF component, since the latter is not capable of propagation at that point.

Therefore, the possibility exists of converting the primary radar signal polarization into a circular polarization and leaving the vertical IFF polarization energized vertically in the same antenna.

The support 21 and the polarizer or polarization grid 22 can also be structurally integrated as a single component.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A radar antenna comprising: a pillbox antenna including a cylindrical parabolic reflector, an upper metal plate and a lower metal plate perpendicular to and extending from said reflector spaced apart and parallel to one another, an intermediate plate spaced between and parallel to said upper and lower plates and forming therewith upper and lower interplate spaces, said intermediate plate spaced from said reflector, a primary radar signal radiator coupled to said lower interplate space with its radiation center on the focal line of said reflector, and deflection means in said interplate spaces adjacent said reflector for deflecting radiation from said lower interplate space to said upper interplate space; and coupling means comprising a pair of identification-friend-foe (IFF) radiators arranged on opposite sides of said primary radar signal radiator and coupled to said lower interplate space for incoupling IFF signals.

2. The antenna of claim 1, wherein:

said primary radar signal radiator comprises a horn-type radiator.

3. The antenna of claim 2, wherein:

said horn-type radiator comprises a deflection horn-type radiator.

4. The antenna of claim 1, wherein:

said primary radar signal radiator comprises an open waveguide.

5. The antenna of claim 1, wherein:

said deflection means comprises an open slot in the space between said intermediate plate and said reflector.

6. The antenna of claim 1, wherein:

said deflection means comprises a pair of 45° surfaces adjacent said reflector.

7. The antenna of claim 1, and further comprising:

support means for said intermediate plate including dielectric material extending along the length of said reflector.

8. The antenna of claim 1, and further comprising:

a metal wall adjacent said radiator closing off the end of said lower interplate space opposite said reflector.

9. The antenna of claim 8, wherein:

said coupling means includes a pair of IFF input radiators spaced from said metal wall so that said metal wall operates as a subreflector for IFF signals.

10. The antenna of claim 9, wherein:

the spacing of said IFF radiators from said metal wall is less than the spacing of the radiation center of said primary radar signal radiator to provide vertical polarization of the signals to be radiated.

11. The antenna of claim 8, and further comprising:

absorption material on said metal wall at selected regions outboard of said radiators.

12. The antenna of claim 8, wherein:

said metal wall is shaped to provide a predetermined radiation coverage of said parabolic reflector.

13. The antenna of claim 1, wherein:

each of said IFF radiators comprises a coaxial line including a matched inner conductor extending into said lower interplate space.

14. The antenna of claim 1, wherein:

said IFF radiators are offset in the transverse direction different distances from the primary radar signal radiator.

15. The antenna of claim 1, and further comprising:

a hybrid circuit coupled to said IFF radiators and secured below said lower metal plate.

16. The antenna of claim 1, and further comprising:

means defining a funnel-shaped radiation opening at the forward end of said upper interplate space.

17. The antenna of claim 1, and further comprising:

a dielectric support for said intermediate plate in said upper interplate space.

18. The antenna of claim 1, and further comprising:

funnel means defining a funnel-shaped radiation opening at the forward end of said upper interplate space; and a polarizer mounted in said funnel means.

19. The antenna of claim 19, wherein:

said polarizer comprises a circularly polarizing grid.

20. The antenna of claim 20, wherein:

said circularly polarizing grid includes means responsive to primary radar signal radiation only of one polarization to produce radiation of another polarization.

21. The antenna of claim 1, and further comprising:

a dielectric support for said intermediate plate in said upper interplate space;

a polarizer integrated with said dielectric support and forward thereof; and funnel means defining a funnel-shaped radiation opening at the forward end of said upper interplate space mounting said polarizer.

* * * * *